United States Patent [19]

Ray et al.

[11] Patent Number: 4,789,149

[45] Date of Patent: Dec. 6, 1988

[54] DOCUMENT GUIDE APPARATUS FOR POCKETING DOCUMENTS

[75] Inventors: Brian E. Ray, Cambridge; Victoria M. Lant, Waterloo; Robert W. Phillips, Brantford, all of Canada

[73] Assignee: NCR Corporation, Dayton, Ohio

[21] Appl. No.: 65,451

[22] Filed: Jun. 23, 1987

[51] Int. Cl.[4] ..... B65H 31/06

[52] U.S. Cl. ..... 271/215; 271/181; 271/220

[58] Field of Search ..... 271/209, 215, 220, 224, 271/212, 181, 219

[56] References Cited

U.S. PATENT DOCUMENTS

| | | | |
|---|---|---|---|
| 3,079,151 | 2/1963 | Maidment | 271/224 |
| 3,793,950 | 2/1974 | Kaneko | 271/209 X |
| 4,223,885 | 9/1980 | Templeton | 271/220 |
| 4,251,000 | 2/1981 | Templeton | 209/547 |
| 4,640,505 | 2/1987 | Placke et al. | 271/209 |

FOREIGN PATENT DOCUMENTS

| | | | |
|---|---|---|---|
| 31465 | 2/1985 | Japan | 271/209 |
| 2059393 | 4/1981 | United Kingdom | 271/209 |

*Primary Examiner*—Richard A. Schacher

*Attorney, Agent, or Firm*—Wilbert Hawk, Jr.; Albert L. Sessler, Jr.; Elmer Wargo

[57] ABSTRACT

An apparatus which facilitates the pocketing of documents in a pocket in a business machine like a sorter. As a document is to be pocketed, it is moved along a rib structure (located on a pusher plate) which has a decelerating portion thereon to decelerate the document and to move the document against a side member in the pocket as it approaches a stop member within the pocket to thereby minimize the noise created by the first few documents entering the pocket. A second rib structure positioned near the top edge of the pusher plate engages the leading edge of a document to direct the document against a side wall in the pocket to also minimize the noise mentioned.

12 Claims, 2 Drawing Sheets

DOCUMENT GUIDE APPARATUS FOR POCKETING DOCUMENTS

BACKGROUND OF THE INVENTION

This invention relates to an apparatus for pocketing documents, like checks, in a pocket of a business machine.

One of the problems with processing documents, like checks, in a business machine, like an encoder, proof machine, or a sorter, is that it is difficult to pocket the documents without malfunctions. A large portion of the problems with processing checks is due to the fact that any one batch of checks to be processed can vary in size from 2½ to 4½ inches in height to about 4½ to 9 inches in length. In addition, many of the checks are wrinkled and "dog eared" prior to being processed.

The pocketing malfunctions may include the following:

1. The leading edge of a document being fed into a pocket may "crash" into the trailing edge of a document already in the pocket;

2. "Fanning out" of the trailing edges of documents already in the pocket may prevent an incoming document from being pocketed; and 3. Due to the "fanning out" mentioned, documents may be inserted out of sequence in the pocket.

A document guide mechanism described in U.S. Pat. No. 4,640,505, which is assigned to the same assignee as is this application, minimized the malfunctions mentioned in the previous paragraph. One of the problems with the guide mechanism disclosed in the named patent was that the first few documents entering an empty pocket created a "chatter" which was noisy and disturbing to persons operating the associated machine. After about a half dozen documents entered a previously empty pocket, the chatter or noise abated.

SUMMARY OF THE INVENTION

The primary object of this invention is to eliminate the chatter or noise caused by the first few documents entering a previously empty pocket as discussed previously herein.

A second object s to accomplish the primary object mentioned while providing a low cost solution which was compatible with the apparatus disclosed in the patent mentioned.

In one aspect, a preferred embodiment of the apparatus of this invention includes an upstream end, a downstream end and a feeding line positioned therebetween; a receiving means located at the downstream end for receiving documents to be pocketed; and feeding means for feeding documents from the upstream end along the feeding line to the receiving means. The receiving means includes a first stationary member against which the leading edges of documents abut when fed into the receiving means; a second stationary member which forms one side of a pocket for receiving the documents to be pocketed; and a pusher plate and means for mounting the pusher plate for movement parallel to and away from the second stationary member to accommodate an increasing stack of documents as documents are pocketed in the receiving means. The pusher plate has a rib structure located on a side thereof facing the second stationary member; and the rib structure has an entry portion and also has a decelerating portion for decelerating the documents being fed into the receiving means by squeezing the documents between the pusher plate and the second stationary member prior to the leading edges thereof abutting against the first stationary member.

In a second aspect, a preferred embodiment of the apparatus of this invention relates to a pusher plate for use in a document pocketing apparatus having a pocket in which documents are pocketed. The pusher plate is a general planar member having a leading edge, a trailing edge, an upper edge, and a lower edge with regard to documents being pocketed in the pocket and a rib structure positioned on a first side of said planar member. The rib structure includes an entry portion located adjacent to the leading edge, a trailing portion located adjacent to the trailing edge, and a document decelerating portion located between the leading and trailing portions.

The objects of the invention mentioned, and advantages of it will be more readily understood in conjunction with the following description, claims and drawing.

DETAILED DESCRIPTION OF THE INVENTION

Figure 1:
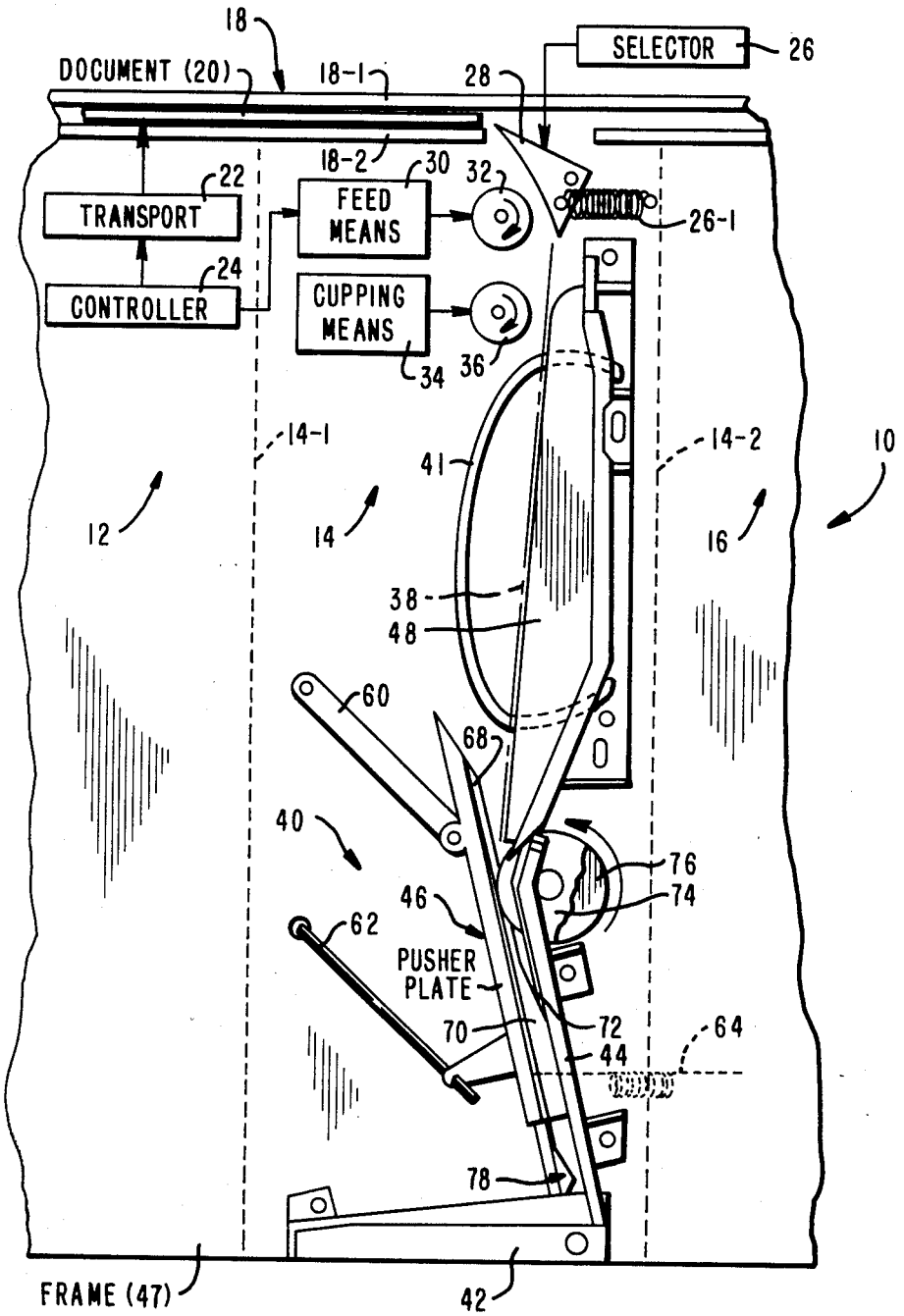
FIG. 1 is a plan view, in partial diagrammatic form, of a pocketing apparatus made according to this invention.

FIG. 1 is a plan view of a portion of a document processing machine, like a sorter 10, which has a plurality of identical sorter pockets 12, 14 and 16 therein, with only pocket 14 being shown in detail. Accordingly, a description of only sorter pocket 14 will be given. The dashed lines 14-1 and 14-2 show the general side boundaries of pocket 14.

The sorter 10 includes a conventional document track 18 having upstanding walls 18-1 and 18-2 which are spaced apart to receive a document 20 therebetween. The side walls 18-1 and 18-2 are slotted to permit conventional feed rollers and pinch rollers (not shown) which are part of the document transport 22 to feed the documents, like 20, sequentially, and in a spaced stream of documents along the document track 18.

When a document 20 is to be pocketed in one of the pockets, 12, 14, 16, a controller 24 selects the document 20 by energizing a selector 26 which moves an associated diverter 28 into the document track 18 to divert the document 20 into the pocket 14, for example. When the selector 26 is deenergized, a spring 26-1 is used to return the diverter 28 to a non-diverting position. Each pocket, like 14, has its own associated feed means 30 shown schematically by a feed wheel 32. The feed means 30 includes a conventional cupping means 34 which includes a rib (not shown) and a pair of spaced rollers 36, for example, which put a convex-concave bend in the document 20 to impart stiffness to the document to facilitate moving it.

The document 20 is then fed along the feeding line represented by dashed line 38 from the upstream end (near diverter 28) to the downstream end represented by the receiving means, designated generally as 40, where the documents, like 20, are pocketed.

The feed means 30 also includes a flexible band 41, which is used to move the trailing edges of documents, like 20, away from the feeding line 38 (at the receiving means 40) so as to enable the leading edge of a document to be pocketed without interference from the trailing edges of documents already in the receiving means 40.

The receiving means 40 (FIG. 1) includes a first stationary member 42, a second stationary member or side member 44, and a pusher plate designated generally as 46, with all three elements named being mounted on the floor or frame 47 of the sorter 10. As documents, like 20, are fed along the feeding line 38 to the receiving means 40, the first document is fed between the side member 44 and the pusher plate 46, and the leading edge of the document 20 eventually abuts against the first stationary member 42. The next document which is fed into the receiving means 40 is fed between the side plate member 44 and the prior document 20 which rests against the pusher plate 46 in the example being described. The thin flexible plastic band 41 (shown in exaggerated thickness in FIG. 1) cooperates with a rib (not shown) on the mounting block 48 to produce a "travelling wave" (near the cupping means 34) which progresses along the feed line 38 ahead of the leading edge of an incoming document 20. It is the travelling "wave" which progresses ahead of a document 20 as it approaches the receiving means 40 and pushes the trailing edges of documents already in the receiving means 40 away to make room for the incoming document 20. A detailed description of the travelling "wave" used to facilitate the pocketing of documents may be found in U.S Pat. No. 4,640,505 mentioned earlier herein.

As stated earlier herein, under the Background of the Invention, when the first few documents were pocketed, they created a chatter when using a document guide mechanism of the type disclosed in the named patent. The present invention minimizes the chatter described.

Figure 2:
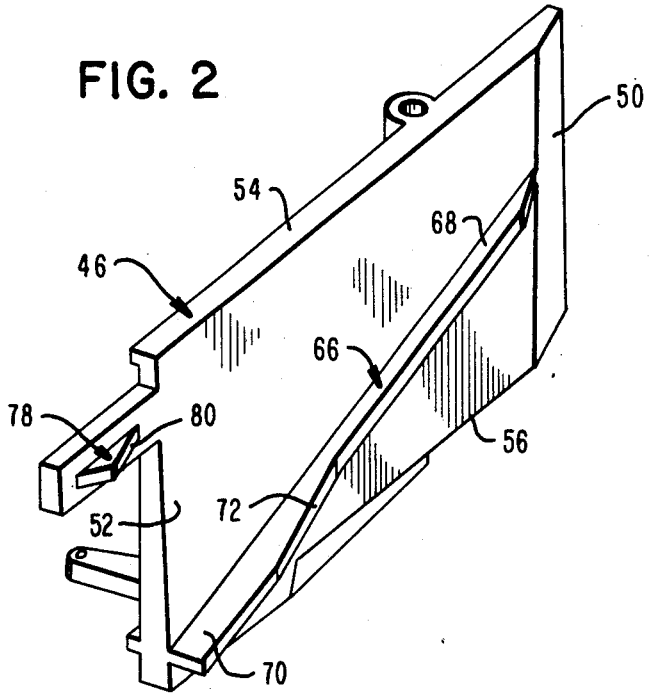
FIG. 2 is a perspective view of a pusher plate shown in FIG. 1.

The pusher plate 46 of the receiving means 40 is shown in more detail in FIG. 2. The pusher plate 46 has a leading edge 50, a trailing edge 52, an upper edge 54, and a lower edge 56 with regard to documents being fed into the receiving means 40. The pusher plate 46 is mounted in the frame 47 of the sorter 10 for parallel movement towards and away from the side member 44 by a four-bar, parallel motion mechanism including links 60 and 62. Each of the links 60 and 62 has one end pivotally secured to the frame 47 and the remaining end secured to the pusher plate 46, as shown in FIG. 1. The pusher plate 46 is resiliently biased towards the side member 44 by a spring 64 shown only diagrammatically and in dashed outline in FIG. 1. As the documents, like 20, accumulate between the pusher plate 46 and the side member 44, the pusher plate 46 is moved to the left (as viewed in FIG. 1) to accommodate the increasing stack of documents.

The pusher plate 46 also includes a rib structure 66, which is shown best in FIG. 2. The rib structure 66 includes an entry portion 66, near the leading edge 50, an exit portion 70, near the trailing edge 52, and a decelerating portion 72 located between the entry portion 68 and the exit portion 70. The rib structure 66 is positioned at an angle of about 15 degrees with regard to the lower edge 56; this design facilitates getting the documents in the receiving means aligned towards the lower edge 56 of the pusher plate 46. The decelerating portion 72 and the exit portion 70 of the rib structure 66 comprise about one fifth of the length of the rib structure 66. The decelerating portion 72 is an up-ramp or inclined ramp which decelerates a document 20 entering the receiving means 40 and minimizes the noise when the leading edge of a document 20 abuts against the first stationary member 42. Notice, from FIG. 1, that when there are no documents in the receiving means 40, the exit portion 70 of the rib structure 66 abuts against the side stationary member 44. Notice, also, that there is a clearance between the entry portion 68 of the rib structure 66 and the side member 44 to permit the leading edge of a document 20 to enter the receiving means 40. As additional documents enter the receiving means 40, each incoming document 20 is inserted between the side member 44 and those documents already forming a stack in the receiving means 40.

The receiving means 40 also includes stacking rollers 74 and 76 (FIG. 1) which facilitate the pocketing of documents in the receiving means 20. The stacking rollers 74 and 76 are spaced apart, are rotated in a counterclockwise direction (as viewed in FIG. 1), and cooperate with the entry portion 68 of the rib structure 66 to drive the document 20 entering the receiving means 40 towards the stationary member 42. The cupping rollers 36 (near the upstream end) cause the resulting concave side of the cupped document to face the mounting block 48, while the stacking rollers 74 and 76 cause the resulting concave side of the cupped document to face the rib structure 66.

In the patent mentioned earlier herein, when a first document (like 20), entered the receiving means (like (40), the stacking rollers (like 74 and 76) continued to drive the document against the first stationary member (like 42). This continued driving action put an "S-shaped" bend in the document. When the stiffness and thickness, for example, were "right", the document tended to spring away from the first stationary member; however, because the document was still being driven by the stacking rollers, its leading edge was driven, again, against the first stationary member, with the result that chatter was created when this action was repeated for the first few documents. While only three pockets are shown in the sorter (like 10), when a sorter which contains 30 pockets was operated, the noise became excessive and sounded like applause. The decelerating portion 72 of the rib structure 66 tends to squeeze a document towards the side member 44 to eliminate the "S-shaped" bend in the first few documents, thereby eliminating the noise problem. After about a half dozen documents are pocketed in a receiving means 40, the chatter problem no longer exists.

The pusher plate 46 (FIGS. 1 and 2) of the receiving means 40 also includes a second rib structure 78 which helps to minimize document chatter in the receiving means 40. The rib structure 78 is positioned close to the upper edge 54 and the trailing edge 52 of the pusher plate 46, as shown best in FIG. 2. The leading edge of a document 20 is decelerated somewhat (at its upper edge) by the ramp side 80 of the rib structure 78. The width of the rib structure 78 is slightly less than the width of the exit portion 70 of the rib structure 66 so that the rib structure 78 pushes the upper edges of the documents, like 20, against the side member 44 to minimize document chatter.

What is claimed is:

1. A document pocketing apparatus comprising:

an upstream end of said apparatus, a downstream end of said apparatus and a feeding line positioned therebetween;

a receiving means located at said downstream end for receiving documents to be pocketed;

feeding means for feeding documents from said upstream end along said feeding line to said receiving means;

said receiving means comprising:

a first stationary member against which the leading edges of documents abut when fed into said receiving means;

a second stationary member which forms one side of a pocket for receiving said documents to be pocketed; and a pusher plate and means for mounting said pusher plate for movement parallel to and away from said second stationary member to accommodate an increasing stack of documents as documents are pocketed in said receiving means;

said pusher plate having a rib structure located on a side thereof facing said second stationary member; and said rib structure having an entry portion and also having a decelerating portion for decelerating the documents being fed into said receiving means prior to the leading edges thereof abutting against said first stationary member and also for moving the documents towards said second stationary member.

2. The document pocketing apparatus as claimed in claim 1 in which said entry portion and said decelerating portion of said rib structure extend substantially along the length of said pusher plate, as measured along said feeding line.

3. The document pocketing apparatus as claimed in claim 2 in which said rib structure and said decelerating portion are dimensioned to provide a document entrance area into said receiving means, and said rib structure has an exit portion which abuts against said second stationary member when there are no documents in said receiving means.

4. The document pocketing apparatus as claimed in claim 3 in which said decelerating portion includes an inclined ramp and in which said decelerating portion is positioned between said entry and exit portions of said rib structure.

5. The document pocketing apparatus as claimed in claim 4 in which said receiving means also includes a floor, with said pusher plate being positioned perpendicularly to said floor;

said rib structure being aligned on said pusher plate with said exit portion being closer to said floor then said entry portion; and said entry, decelerating, and exit portions of said rib structure being aligned in essentially a straight line.

6. The document pocketing apparatus as claimed in claim 5 in which said pusher plate has a second rib structure located on said side facing said secondary member;

said second rib structure being located more distantly from said floor than said first rib to move the upper ends of said documents towards said second stationary member.

7. The document pocketing apparatus as claimed in claim 6 in which said second rib structure includes a ramp portion.

8. The document pocketing apparatus as claimed in claim 7 in which said decelerating and exit portions of said rib structure together comprise about one fifth of the length of said rib structure.

9. A pusher plate for use in a document pocketing apparatus having a pocket in which documents are pocketed, comprising:

a generally planar member having a leading edge, a trailing edge, an upper edge, and a lower edge with regard to documents being pocketed in said pocket; and a rib structure positioned on a first side of said planar member;

said rib structure comprising an entry portion located adjacent to said leading edge, a trailing portion located adjacent to said trailing edge, and a document decelerating portion located between said leading and trailing portions.

10. The pusher plate as claimed in claim 9 in which said rib structure is positioned on said first side at an angle which converges towards said trailing and lower edges of said pusher plate to move documents towards the bottom of said pocket, and in which said pusher plate has a second rib structure located near said trailing and upper edges of said planar member to move the upper edges of said documents against a stationary planar side member of said pocket.

11. The pusher plate as claimed in claim 10 in which said entry portion of said rib structure has a width which is less than the width of said exit portion to provide an opening for documents being inserted into said pocket; and said document decelerating portion being a ramp joining said entry and exit portions of said rib structure to move documents against said stationary planar side member.

12. The pusher plate as claimed in claim 11 in which said decelerating and exit portions of said rib structure together comprise about one fifth of the length of said rib structure.

* * * * *